US005381820A

United States Patent [19]

Chandler

[11] Patent Number: 5,381,820

[45] Date of Patent: Jan. 17, 1995

[54] HOSE REEL APPARATUS

[76] Inventor: William R. Chandler, Rt. 2, Box 167-B, Baldwyn, Miss. 38824

[21] Appl. No.: 222,417

[22] Filed: Apr. 4, 1994

[51] Int. Cl.[6] ..... B65H 75/34

[52] U.S. Cl. ..... 137/355.23; 137/355.16

[58] Field of Search ..... 137/355.23, 355.26, 137/355.27, 355.16; 242/86

[56] References Cited

U.S. PATENT DOCUMENTS

| | | | |
|---|---|---|---|
| 440,838 | 11/1890 | Chapman | 137/355.26 |
| 1,908,852 | 5/1933 | Lea | 137/355.23 |
| 2,071,174 | 2/1937 | Parker | 137/355.23 |
| 3,460,563 | 8/1969 | Bresin et al. | 137/355.26 |
| 3,476,139 | 11/1969 | Guthrie | 137/355.16 |
| 3,889,896 | 6/1975 | O'Hara | 137/355.23 |

*Primary Examiner*—A. Michael Chambers
*Attorney, Agent, or Firm*—E. Michael Combs

[57] ABSTRACT

A guide sleeve is mounted to a bracket, with the guide sleeve arranged to guide a pneumatic air hose therethrough, with the pneumatic air hose arranged for winding about a spring-loaded reel structure, with the spring-loaded reel structure arranged for mounting to the handle portion of an associated air compressor.

4 Claims, 4 Drawing Sheets

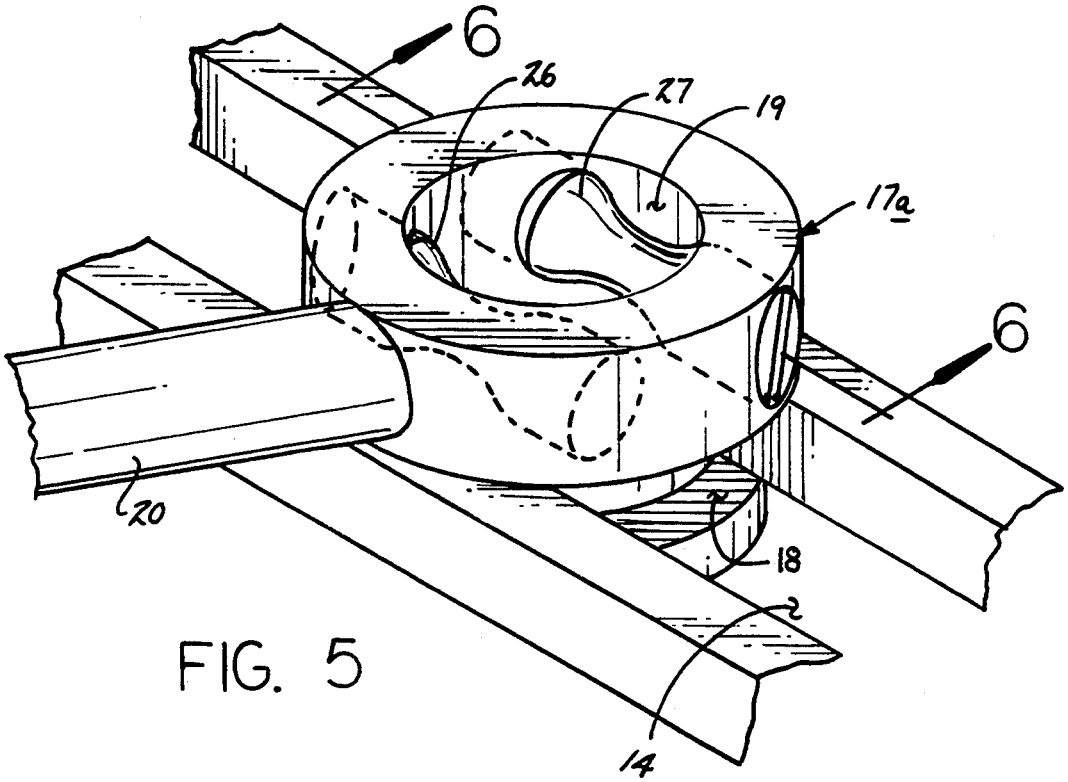
FIG. 5
FIG. 6
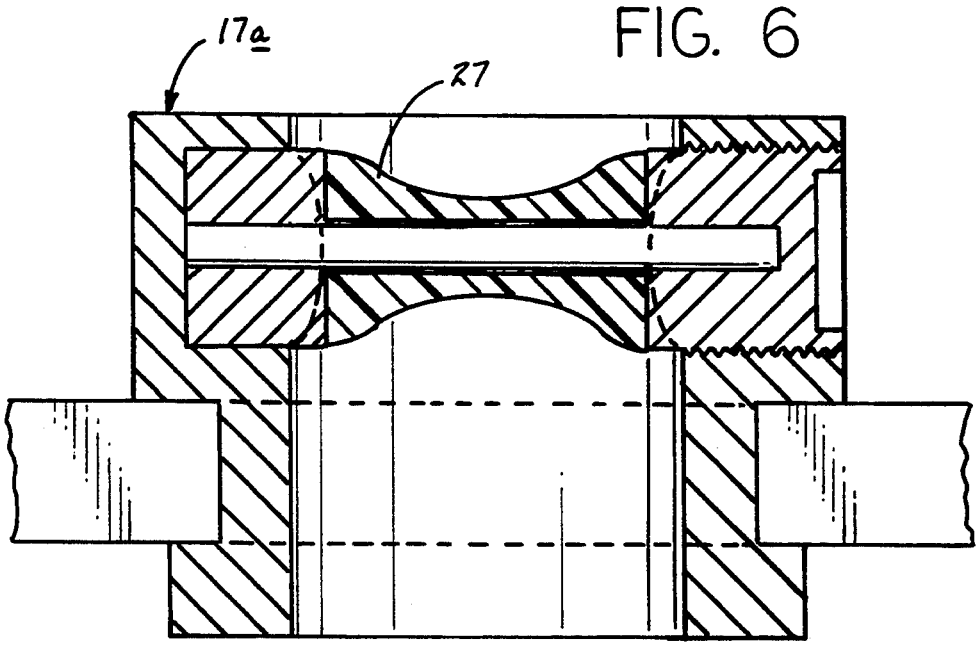

HOSE REEL APPARATUS

BACKGROUND OF THE INVENTION

1. Field of the Invention

The field of invention relates to guide hose structure, and more particularly pertains to a new and improved hose reel apparatus wherein the same is arranged to provide for support and guidance of a pneumatic hose about a reel.

2. Description of the Prior Art

Hose reel structure is indicated in the prior art and exemplified by the U.S. Pat. Nos. 4,813,627; 5,007,598; 4,979,693; 4,732,345; and 4,384,688.

The instant invention attempts to overcome deficiencies of the prior art by providing for a compact hose reel structure arranged for ease of retraction and extension from a reel structure mounted to a compressor handle and in this respect, the present invention substantially fulfills this need.

SUMMARY OF THE INVENTION

In view of the foregoing disadvantages inherent in the known types of hose winding reel apparatus now present in the prior art, the present invention provides a hose reel apparatus wherein the same includes a bracket member arranged for mounting to a compressor handle. As such, the general purpose of the present invention, which will be described subsequently in greater detail, is to provide a new and improved hose reel apparatus which has all the advantages of the prior art hose reel apparatus and none of the disadvantages.

To attain this, the present invention provides a guide sleeve mounted to a bracket, with the guide sleeve arranged to guide a pneumatic air hose therethrough, with the pneumatic air hose arranged for winding about a spring-loaded reel structure, with the spring-loaded reel structure arranged for mounting to the handle portion of an associated air compressor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hose reel apparatus which has all the advantages of the prior art hose reel apparatus and none of the disadvantages.

It is another object of the present invention to provide a new and improved hose reel apparatus which may be easily and efficiently manufactured and marketed.

It is a further object of the present invention to provide a new and improved hose reel apparatus which is of a durable and reliable construction.

An even further object of the present invention is to provide a new and improved hose reel apparatus which is susceptible of a low cost of manufacture with regard to both materials and labor, and which accordingly is then susceptible of low prices of sale to the consuming public, thereby making such hose reel apparatus economically available to the buying public.

Still yet another object of the present invention is to provide a new and improved hose reel apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a modified guide sleeve structure.

FIG. 6 is an orthographic view, taken along the lines 6—6 of FIG. 5 in the direction indicated by the arrows.

DESCRIPTION OF THE PREFERRED EMBODIMENT

Figure 1:
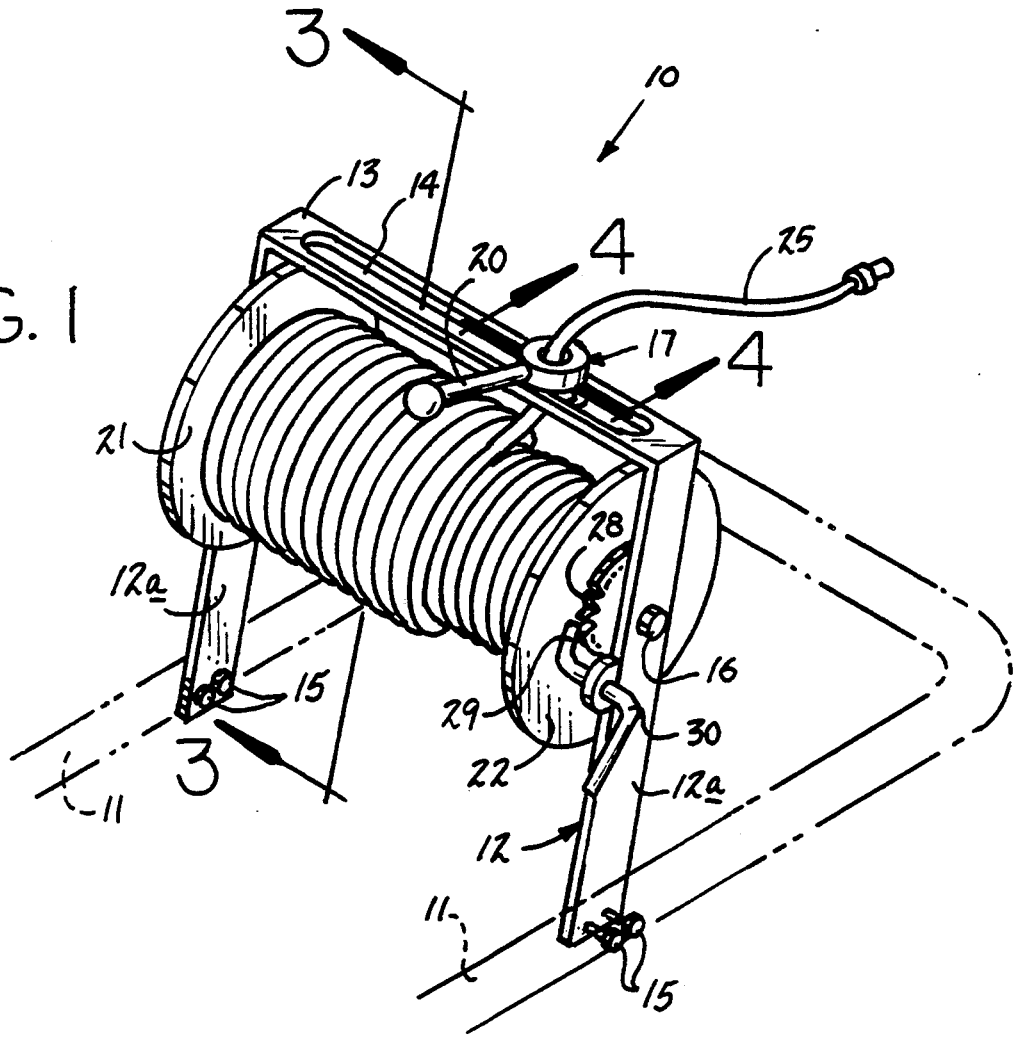
FIG. 1 is an isometric illustration of the invention.
Figure 2:
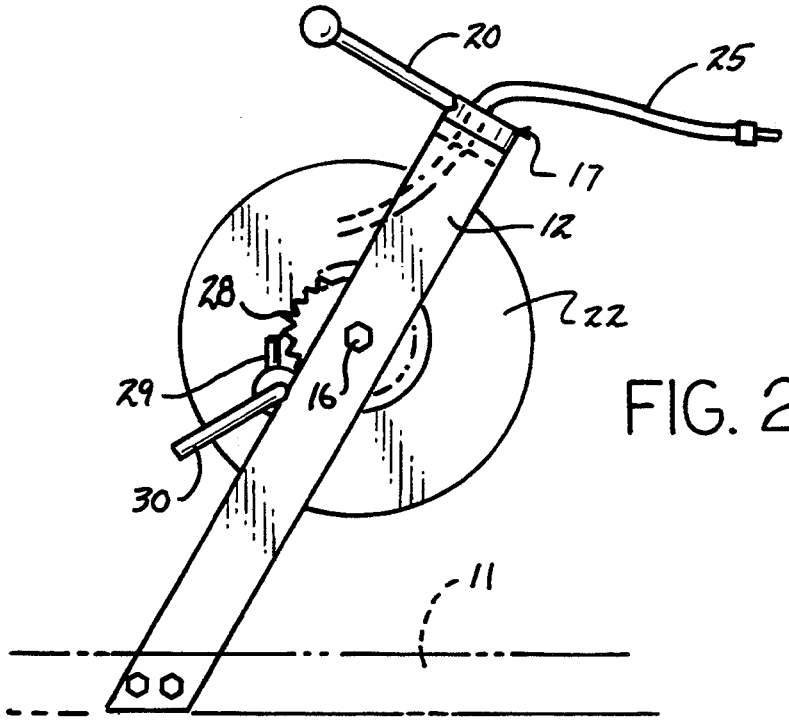
FIG. 2 is an orthographic end view of the invention.
Figure 3:
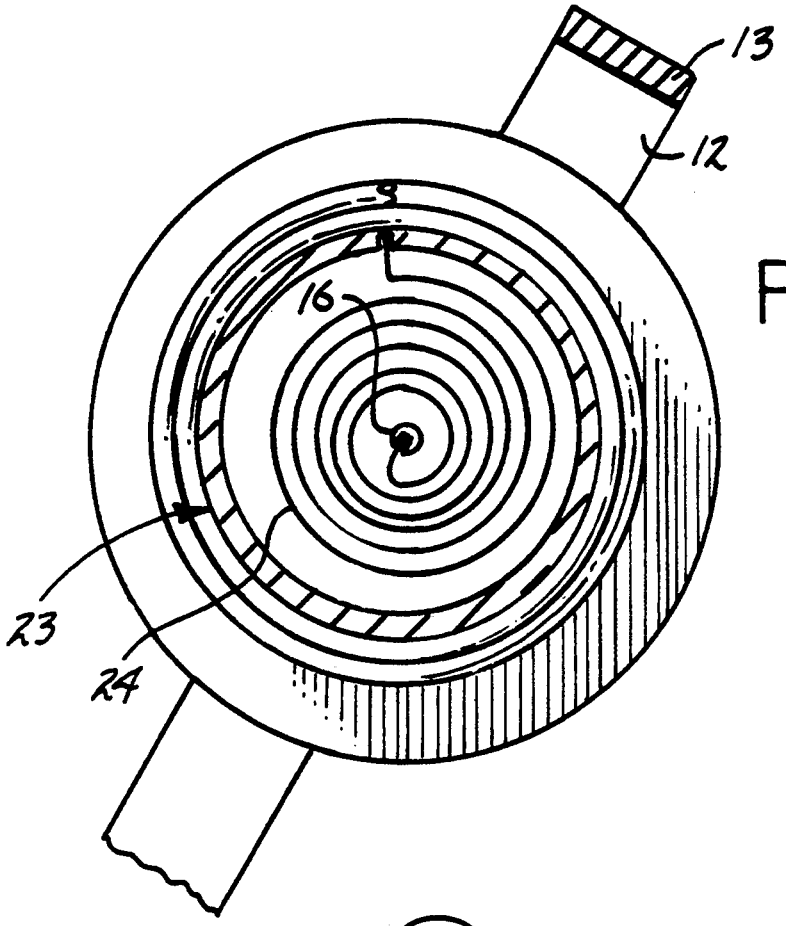
FIG. 3 is an orthographic view, taken along the lines 3—3 of FIG. 1 in the direction indicated by the arrows.
Figure 4:
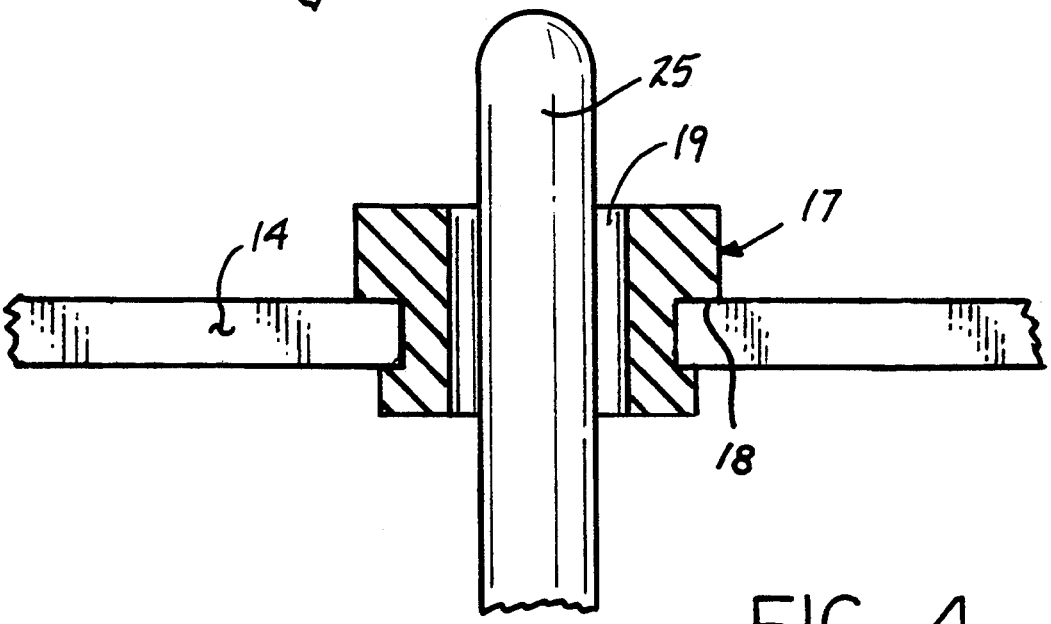
FIG. 4 is an orthographic view, taken along the lines 4—4 of FIG. 1 in the direction indicated by the arrows.

With reference now to the drawings, and in particular to FIGS. 1 to 8 thereof, a new and improved hose reel apparatus embodying the principles and concepts of the present invention and generally designated by the reference numeral 10 will be described.

More specifically, the hose reel apparatus 10 of the instant invention essentially comprises the organization mounted relative to an air compressor (not shown), such that an air compressor handle having spaced air compressor handle legs 11 (see FIG. 1) is arranged to mount a U-shaped mounting bracket 12 having a bracket connecting plate 13 extending between the bracket legs 12*a*, with an individual leg mounted to an individual one of the handle legs 11. The connecting plate 13 includes an elongate slot 14 connected therethrough. Fasteners 15 mount each of the bracket legs 12*a* to an individual handle leg 11. A reel axle 16 mounts a reel housing 23 (see FIG. 3) between the bracket legs 12*a* and between first and second reel plates 21 and 22 positioning the reel housing 23 therebetween guiding a pneumatic air hose 25 about the reel housing. A retraction spring 24 positioned within the housing biases the housing to wind the hose thereabout, with the spring 24 indicated in FIG. 3, mounted to the axle 16 that is fixedly secured to the bracket legs 12*a*, with the reel housing rotatably wound thereabout. An annular gear rack 28 is mounted to the second reel plate 22 and is arranged for the individual gear teeth to engage a pawl abutment 29 that in turn is mounted to a pawl lever 30, that in turn is pivotally mounted to a bracket leg 12*a* in adjacency to the second reel plate 22, such that the pawl abutment 29 when engaged with the teeth prevents the winding of the pneumatic air hose 25 about the reel housing 23.

A guide sleeve 17 is slidably received within the elongate slot 14, and more specifically an annular groove 18 within the guide sleeve 17 is received within the elongate slot 14 to permit sliding of the guide sleeve 17 along the connecting plate 13, with a sleeve handle 20 fixedly secured to the guide sleeve 17 permitting sliding guidance of the air hose along the connecting plate 13.

Figure 7:
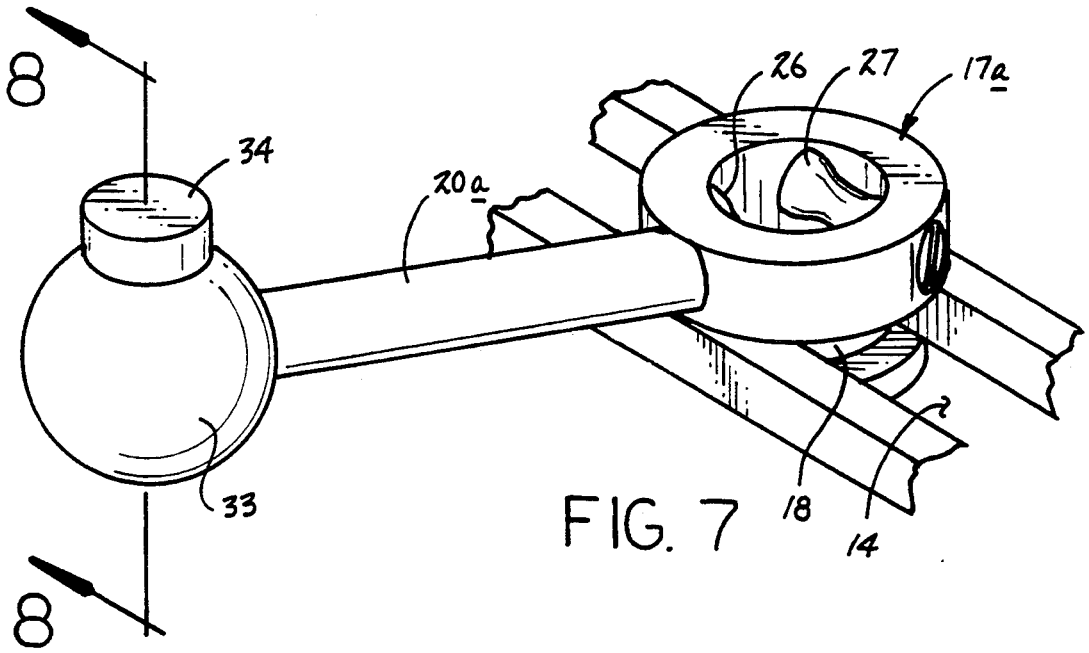
FIG. 7 is an isometric illustration of a modified guide sleeve handle.
Figure 8:
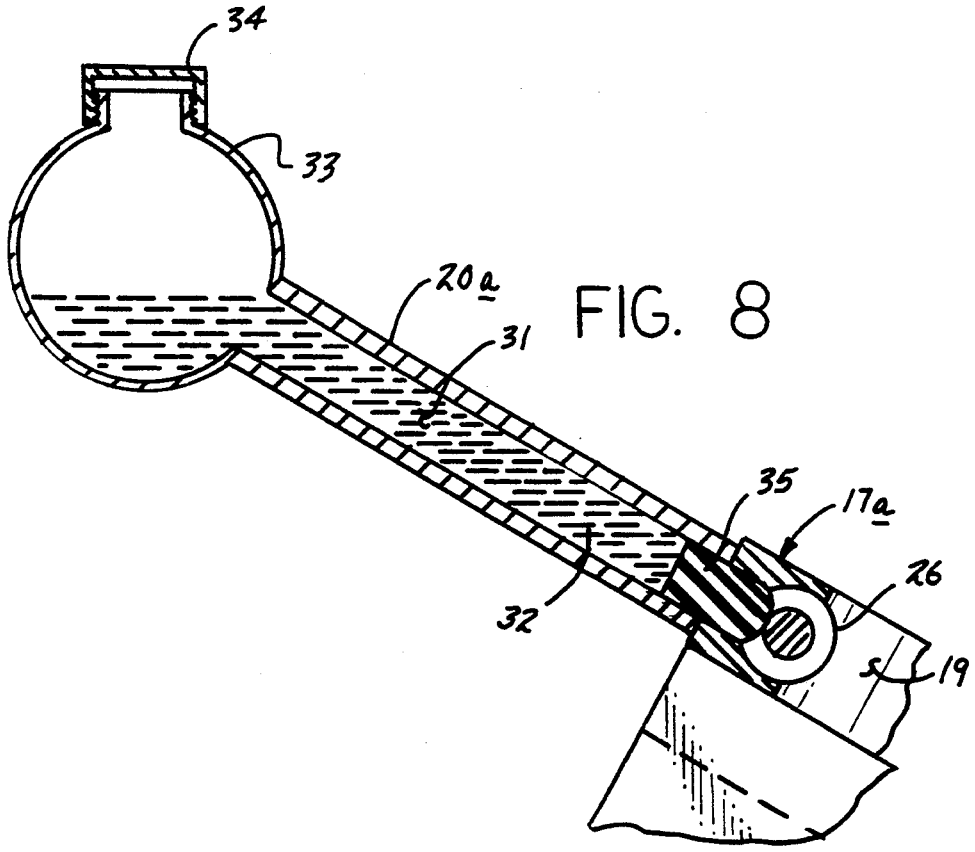
FIG. 8 is an orthographic view, taken along the lines 8—8 of FIG. 7 in the direction indicated by the arrows.

The FIG. 5 indicates a modified guide sleeve 17*a* to include spaced first and second guide rolls 26 and 27 arranged in a parallel relationship to receive the pneumatic air hose 25 therebetween in a guiding relationship to enhance sliding guidance of the air hose therethrough, wherein a modified handle 20*a*, such as indicated in FIGS. 7 and 8, further includes a reservoir 33 mounted to an outermost distal end of the handle 20*a*, with a reservoir cap 34 removably mounted relative to the reservoir 33 to permit replenishment of a lubricant 32 within the reservoir that is directed through a handle conduit 31 directed coextensively of the handle 20*a*, such that a fluid transmissible sponge member 35 in fluid communication with the lubricant 32 within the handle conduit 31 engages the first guide roll 26 to direct lubricant thereon and onto the hose to further prevent sticking and binding of the pneumatic air hose 25 as it is directed through the modified guide sleeve 17*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hose reel apparatus, comprising, a U-shaped mounting bracket having spaced bracket legs, and a connecting plate extending fixedly between the bracket legs, and an elongate slot directed through the connecting plate, with a guide sleeve slidably mounted along the slot, with the guide sleeve having an annular groove receiving the connecting plate coextensively of the slot, with a handle mounted to the guide sleeve to direct the guide sleeve along the slot, and a reel housing mounted between the bracket legs, the reel housing having a first reel plate adjacent one of said bracket legs, and a second reel plate adjacent a further of said bracket legs, with the reel housing extending coextensively between the first reel plate and the second reel plate, and a pneumatic air hose wound about the reel housing, with the guide sleeve having a guide bore, with the pneumatic air hose directed through the guide bore.

2. An apparatus as set forth in claim 1 including biasing means to retract the pneumatic air hose about the reel housing between the first reel plate and the second reel plate, and a gear rack mounted to the second reel plate, with an abutment pawl pivotally mounted to one of said bracket legs for engaging the gear rack to prevent biased winding of the pneumatic air hose about the reel housing.

3. An apparatus as set forth in claim 2 wherein the guide sleeve includes a first guide roll and a second guide roll positioned within the guide bore, with the first guide roll and the second guide roll arranged in a spaced parallel relationship relative to one another, with the first guide roll positioned in adjacency to the handle, with the pneumatic air hose directed between the first guide roll and the second guide roll.

4. An apparatus as set forth in claim 3 wherein the handle includes a handle conduit directed coextensively therethrough, and a reservoir mounted to the handle spaced from the first guide roll, with the reservoir having a reservoir cap removably mounted relative to the reservoir, with a lubricant contained through the handle conduit, with said lubricant arranged for replenishment through the reservoir, with the reservoir in fluid communication with the handle conduit, and a fluid transmissible sponge mounted within the handle conduit in contiguous communication with the first guide roll, with the fluid transmissible sponge in fluid communication with the handle conduit to direct said lubricant through the sponge onto the first guide roll and direct said lubricant onto the pneumatic air hose when it is directed between the first guide roll and the second guide roll.

* * * * *